United States Patent [19]

van der Klaauw

[11] Patent Number: 4,763,712

[45] Date of Patent: Aug. 16, 1988

[54] PLIABLE PARTITION

[75] Inventor: Willem T. J. van der Klaauw, Weert, Netherlands

[73] Assignee: Pella B.V., Panningen, Netherlands

[21] Appl. No.: 45,217

[22] Filed: Apr. 30, 1987

Related U.S. Application Data

[63] Continuation of Ser. No. 829,866, Feb. 18, 1986, abandoned, which is a continuation of Ser. No. 559,702, Dec. 9, 1983, abandoned.

[30] Foreign Application Priority Data

Dec. 10, 1982 [NL] Netherlands ..... 8204792

[51] Int. Cl.[4] ..... E06B 3/96

[52] U.S. Cl. ..... 160/84.1

[58] Field of Search ..... 160/84 R, 84 H, 84 V

[56] References Cited

U.S. PATENT DOCUMENTS

| | | | |
|---|---|---|---|
| 3,029,867 | 4/1962 | Maurer | 160/84 H |
| 3,092,870 | 6/1963 | Baer | 160/229 R |
| 3,599,702 | 8/1971 | Bedard . | |
| 3,850,223 | 11/1974 | Tompkins | 160/84 R |
| 3,979,861 | 9/1976 | Fromme et al. | 160/118 X |
| 4,199,018 | 4/1980 | Hirschel et al. | 160/84 R |
| 4,276,919 | 7/1981 | Walters . | |

FOREIGN PATENT DOCUMENTS

| | | | |
|---|---|---|---|
| 68687 | 3/1949 | Denmark | 160/84 R |
| 93592 | 6/1962 | Denmark | 160/84 R |
| 371887 | 10/1963 | Fed. Rep. of Germany . | |
| 455222 | 6/1968 | Fed. Rep. of Germany . | |
| 1683185 | 10/1969 | Fed. Rep. of Germany | 160/84 V |
| 1683191 | 1/1971 | Fed. Rep. of Germany . | |
| 2506469 | 8/1975 | Fed. Rep. of Germany | 160/84 H |
| 2559443 | 11/1976 | Fed. Rep. of Germany | 160/84 V |
| 8103043 | 10/1981 | PCT Int'l Appl. . | |

*Primary Examiner*—Ramon S. Britts
*Assistant Examiner*—David M. Purol
*Attorney, Agent, or Firm*—Birch, Stewart, Kolasch & Birch

[57] ABSTRACT

A folding partition (1), for example, a door or a wall, made up of modules. Each module includes four panels arranged in two opposite pairs of hinged panels (4) and connectors (5) interconnecting said pairs along the non-hinged edges of the panels to form a box-shaped module (3) which can be suspended from a guide. Connectors of adjacent modules can be connected with one another. Each connector comprises two coupling members extending each along a non-hinged edge of a panel and two or more bridge pieces arranged between the coupling members, while the coupling members of the connectors of adjacent modules can be coupled with one another, by U-shaped coupling strips (13), in order to have the partition readily manufactured on an industrial scale and easily transported and mounted to and on the building site respectively.

12 Claims, 4 Drawing Sheets

PLIABLE PARTITION

This application is a continuation of application Ser. No. 829,866 filed on Feb. 18, 1986 now abandoned, which was a continuation of application Ser. No. 559,702, now abandoned, filed on Dec. 9, 1983.

BACKGROUND OF THE INVENTION

The invention relates to a folding partition, for example a door or a wall, made up of modules. Each module includes four panels arranged in two opposite pairs of hinged panels. Connectors are provided to interconnect the pairs along the non-hinged edges of the panels to form a box-shaped module which can be suspended from a guide. Connectors of adjacent modules can be connected with one another.

SUMMARY OF THE INVENTION

An object of the invention is to provide a foldable partition of the kind set forth above which can be readily manufactured on an industrial scale and which can be easily transported and mounted to and on the building site respectively.

The foldable partition embodying the invention is characterized in that each connector includes two coupling members each extending along a non-hinged edge of a panel and two or more bridge pieces arranged between the coupling members. The coupling members of the connectors of adjacent modules can be coupled with one another.

Thanks to the use of bridge pieces between the coupling members of the connectors, transportation to the place of use can be advantageously carried out because the panels of the modules can be readily joined flat one on the other, that is to say, without "air" being present in the shipment. In forming the folding partition, one need only couple the modules with one another by the coupling members in order to obtain the desirable folding partition. Thus, the mounting time is appreciably reduced.

The coupling between the opposite coupling members can be established by means of longitudinal flanges connected therewith.

In order to obtain coupling members of identical cross-section for all panels, it is preferred to use a U-shaped coupling strip, which can be previously connected with one of the flanges and the other limb of which hooks around the adjacent flange to form a snap joint. Such a construction ensures a joint between the modules on two sides of the partition and along the whole height thereof, which guarantees a firm connection. Moreover, the penetration of sound is thus reduced.

The cost price and the mounting time are further reduced when in accordance with the invention the hinge, the coupling member an the coupling flanges are designed as a single extruded component.

In order to improve the aesthetic appearance of the partition and also to improve the fire safety of the partition, each panel edge is extended at the hinge strips between the panels of a module and at the coupling members. In this way the hinges are not seen.

When the partition is a flat partition in which the panels of a module stretch themselves into a flat position by means of spring blades fastened to two opposite panels, the bridge piece is provided with means for slidably guiding these spring blades.

Each bridge piece may then be formed with two vertically aligned sockets through which pins for guiding the spring blades can be passed. Furthermore, a bridge piece may be provided with a socket for receiving a wheel carrying pin. The wheels are adapted to roll along a top guide in order to position the foldable partition.

BRIEF DESCRIPTION OF THE DRAWINGS

The above-mentioned and further features will become more apparent from the following description of two embodiments shown in the drawing.

The drawing shows in.

DESCRIPTION OF THE PREFERRED EMBODIMENTS

Figure 1:
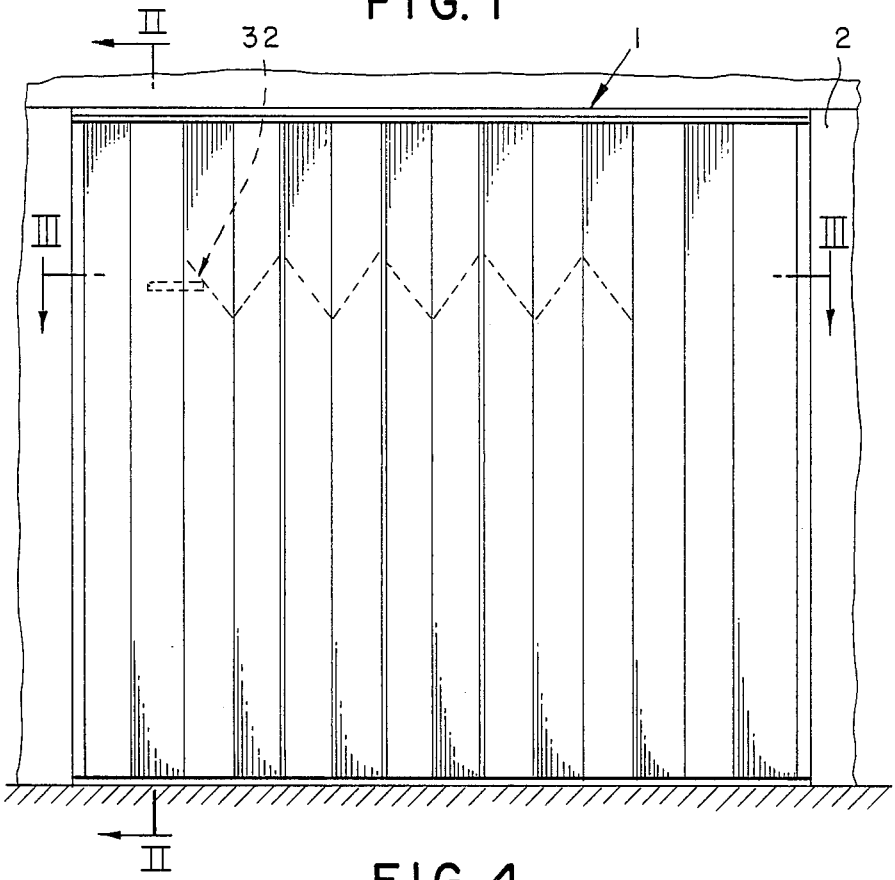
FIG. 1 a front view of a foldable partition.
Figure 2:
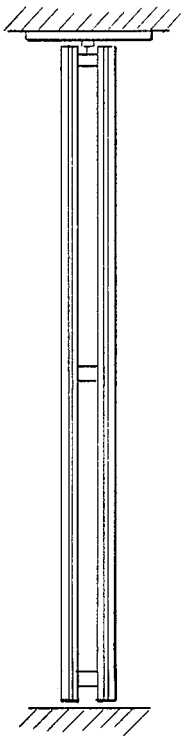
FIG. 2 a vertical sectional view taken on the line II in FIG. 1.
Figure 4:
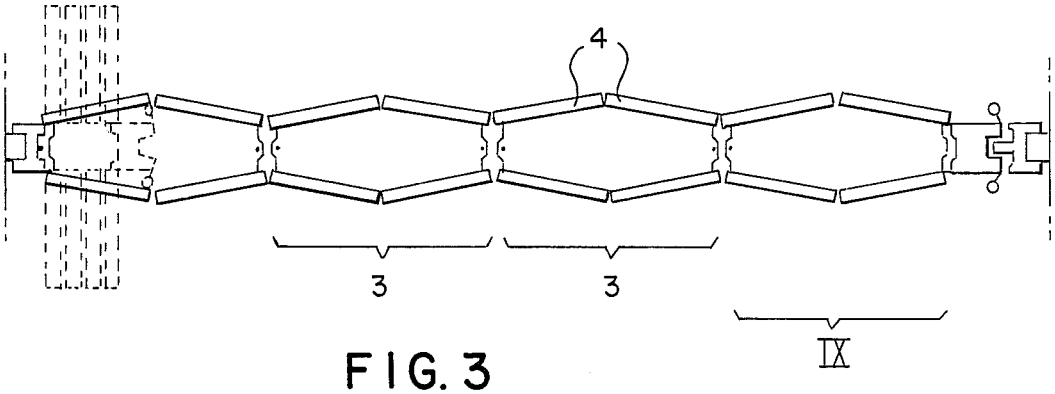
FIGS. 3 and 4 a horizontal sectional view taken on the line III—III of a flat door and a double-paneled door respectively, FIG. 5 a horizontal sectional view like FIG. 3 on an enlarged scale, some parts being broken away, FIG. 6 a horizontal sectional view like FIG. 5 on an enlarged scale of a partition in a stretched position, FIG. 7 a sectional view like FIG. 6 of a partition in the folded position, FIG. 8 a perspective view of the hinge part of FIG. 6, some parts being broken away, FIG. 9 a sectional view like FIG. 6, of a partition in the form of a double-paneled wall.
Figure 3:
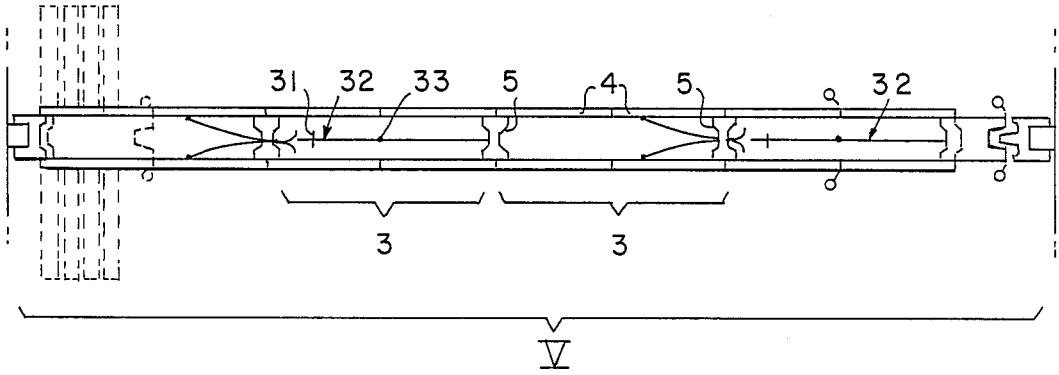
Figure 5:
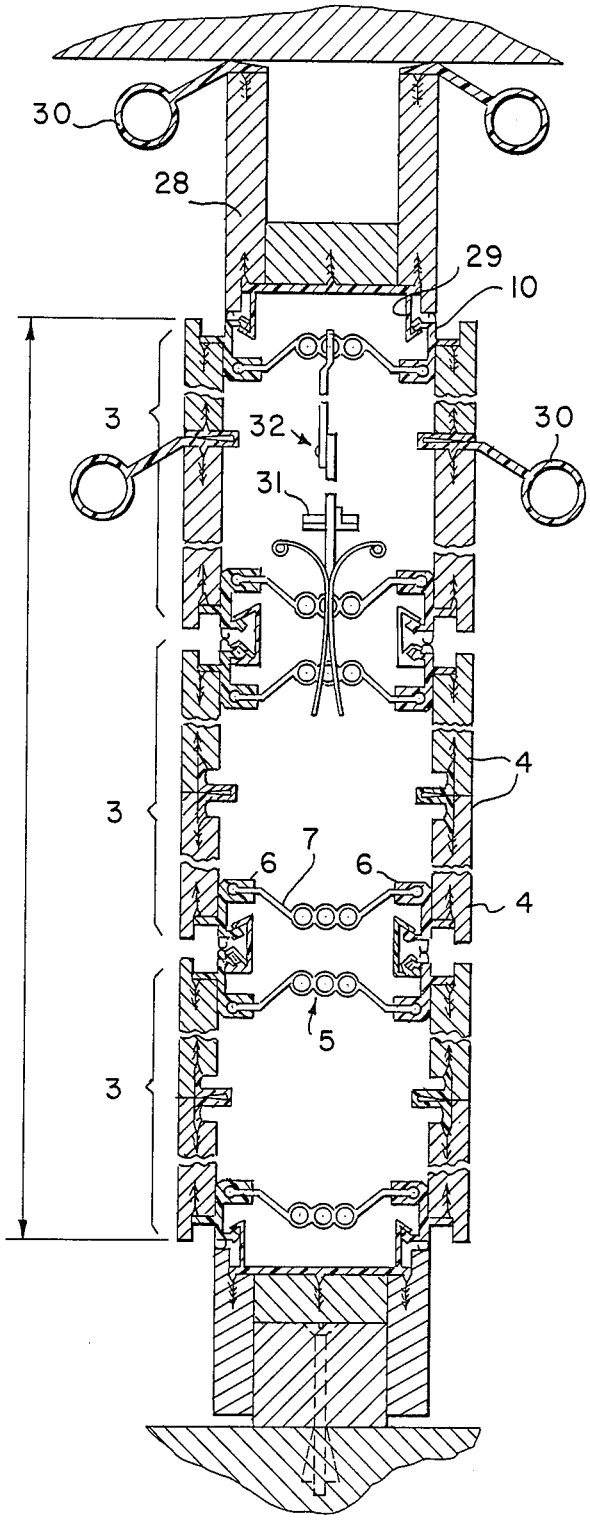

In the following description reference, numeral 1 designates a folding partition which, for example, may close an opening in a wall 2. The partition 1 may be designed to provide a flat wall (FIG. 3) or to provide a double-paneled wall or door (FIG. 4).

The partition comprises a plurality of modules 3 hanging side by side with each module including two pairs of pivotally interconnected panels 4. The panels opposite each other in the module are interconnected along their free longitudinal edges by connectors 5. Adjacent connectors are coupled with one another in a manner further described hereinafter with reference to FIGS. 5 to 9.

FIGS. 5 to 9 show in detail the connections between the panels 4. Connectors 5 include a coupling member 6 arranged along the free, vertical edge of each panel 4 and a bridge piece 7 interconnecting the coupling members 6 of a module. The coupling member 6 has a T-shaped web part 8 having on one side a thickened part 9 with a longitudinal slot therein for receiving the edge of the bridge piece 7 (see FIG. 6).

The other end of the T-shaped web part 8 is provided with a flange 10 as well as with a flexible member 11. The leg of the T-shaped web part 8 is connected with the hinge piece 12 which is inserted in a longitudinal groove in the free edge of the panel 4. The hinge and the coupling member with the thickened part 9 and the flange 10 and the closure member 11 are preferably made from synthetic resin as a single unit by extrusion.

The coupling member 6 described above is suitable for all modules of the door. For example, the coupling member can be used for connection with an adjacent coupling member of an adjacent module (see FIG. 5 or 6). For this purpose a U-shaped coupling strip 13 is clamped over the flange 10 of a coupling member. One limb 14 of the coupling strip 13 has an inwardly directed projection 15 which snaps around the flange 10. For coupling adjacent modules together, it is only necessary to position the flange 10 of the connecting member of the second module behind the other limb 16 of the coupling strip, so that a film connection is established. The closure members 11 and the coupling strip 13 provide a double closure against the passage of sound. The connection between the modules is uncoupled by pressing some tool between the closure members 11 against the web of the U-shaped coupling strip 13 so that one limb 16 is released from the associated flange 10.

Figure 6:
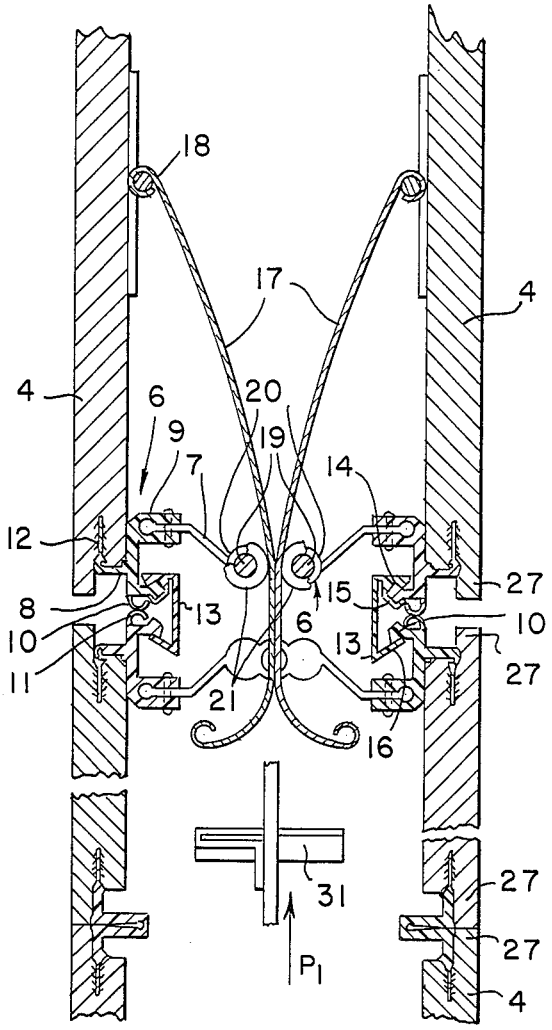
Figure 7:
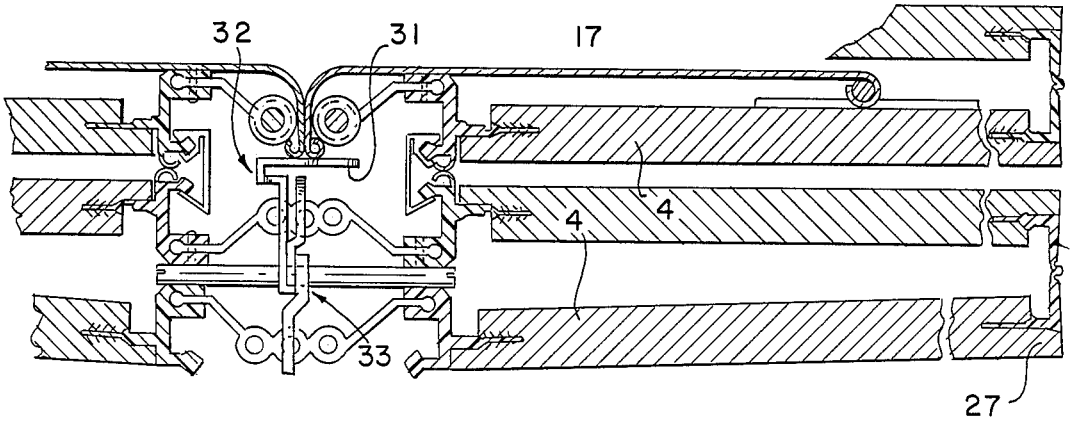
Figure 8:
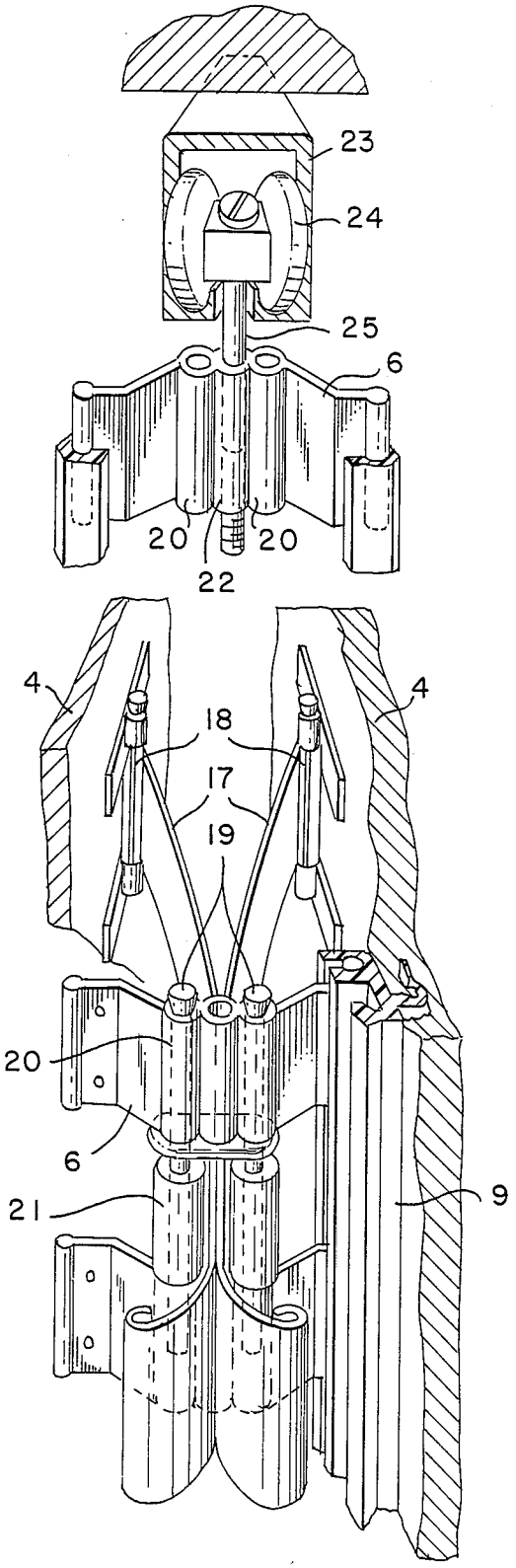
Figure 9:
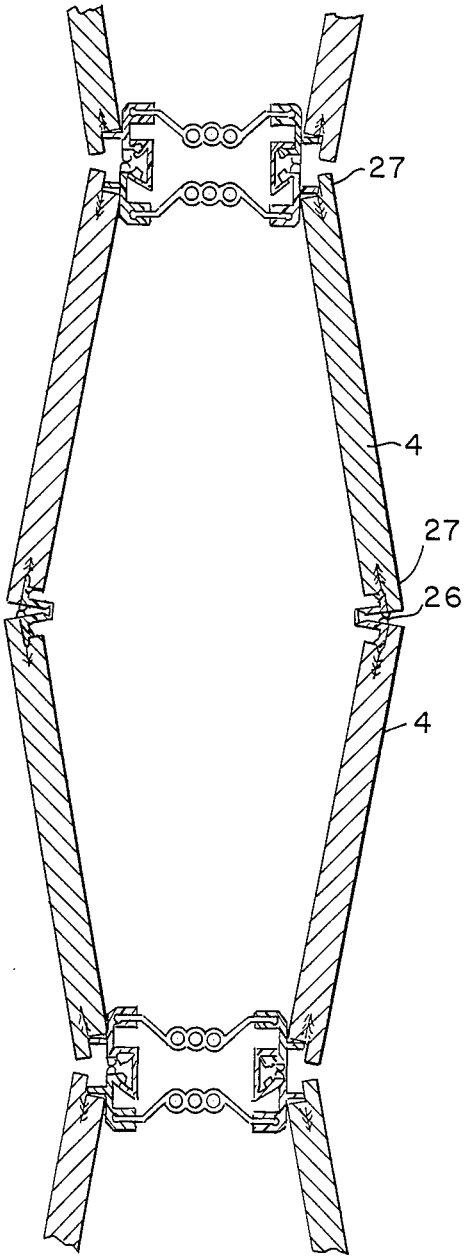

In order to obtain a flat wall, a stretching mechanism is required. This mechanism is formed in this case by two relatively co-operating blade springs 17. One end of each blade spring is pivotally connected at 18 with the inner side of a panel 4. The other end is bent over to form a hook so that when the panels 4 are swung open out of the position shown in FIG. 6 into that shown in FIG. 7 the curved surfaces of the spring pass one along the other. The leaf springs are supported by rollers 21 carried by pins 19 passed through two vertically aligned sockets 20 of the bridge pieces 7 as shown in FIG. 8. These pins together with the rollers 21 freely rotatable about the pins constitute a constand pressure point between the leaf springs 17. This pressure point shifts, when the panels 4 are stretched, gradually further away from the pins 19 (see FIG. 7) with respect to FIG. 6 show that the leaf springs assume the curved, tensioned position shown in FIG. 6. This results in a force directed inwardly on the panels 4 at the hinge points 18 so that the panels become co-planar. A pressing piece 31 of a scissor mechanism 32 movable in the direction of the arrow P1 in the neighbouring module exerts pressure on the bent spring ends, when the panels are folded, so that the panels of the leaf springs concerned are pressed to one another.

The scissor mechanism 32 comprises two arms pivotally coupled with one another at 33, the free ends of which are pivotally suspended to a pin inserted into a third socket 20 of the bridge piece 7.

From FIG. 8 it will be apparent that the third socket 22 may receive a pin 25 which has wheels 24 mounted thereon. The wheels 24 are adapted to roll in the top guide 23. The height of the pin in the socket 22 is adjustable so that the height of the module can be set.

The bridge pieces are bent in cross-section. This shape provides space for the linking and pressing mechanism in the folded state of the partition (see FIG. 7) so that the panels can be joined as closely as possible to one another. Furthermore, this shape provides some resilience between two opposite panels 4 and also reduces sound transmission.

The partition according to the invention may also be designed as a double-paneled door as shown in FIG. 4, in which case the stretching device of FIG. 6 can be omitted. In this form of the door, a hinge between the panels 4 of one module is provided with a stop ridge 26, which ensures that in the stretched stage the panels 4 remain at an angle to one another so that opening the wall or door is facilitated (see FIG. 9).

In both embodiments the panel edges 27 are extended at the hinges and the coupling members. With this arrangement, the coupling members are not seen. Also, a sound damping chamber is formed in combination with the closure members 11.

The partition may be provided with a locking element 28 attached to the connecting member at the end of the last module. The locking element may be provided, like the connection between the modules, with a flexible member 29, which hooks around the flange 10 of the connecting member. The locking element 28 is provided with a continuous handle 30.

On one or more of the hinges between the panels 4 a similar handle 30 for folding open the module may also be provided.

From the foregoing it will be apparent that each module can be composed of the same component parts and that through the use of a small number of elements such as coupling strips 13, flexible members 29 and the like a complete partition of various dimensions can be built up. By using pivotable spring elements 17, pins 19, and rollers 21, a flat partition can be made in a simple manner from a double-paneled partition. This overall concept considerably limits manufacturing and mounting costs.

The invention is not limited to the embodiments described above.

What is claimed is:

1. A folding partition comprising modules, each of said modules having first and second sides which are disposed opposite to ech other and including a first pair of hingedly connected panels on said first side of the module and a second pair of hingedly connected panels aligned with said first pair of panels, said second pair of panels being located on said second side of the module, each of said panels having an unhinged edge, each of said panels having an exterior side and an interior side facing an opposite module side, said unhinged edge of each of said panels having a coupling member extending therealong on said interior side of said each panel, said coupling members having a T shaped web part formed of a base part and a cross part, a thickened part extending at a right angle from said web cross part and having a longitudinal slot formed therein, a flange also extending at a right angle from said web cross part and being spaced from said thickened part, a bridge piece extending between coupling members located on facing interior sides and entering into said longitudinal slots of said coupling members, and connecting means spaced from said bridge piece for connecting said flanges of adjacent ones of said coupling members.

2. A partition as claimed in claim 1, characterized in that said flanges extend parallel side by side and in that said connecting means includes a coupling strip of U-shaped cross-section fastened previously to one flange and hooked behind the adjacent flange to form a snap joint.

3. A partition as claimed in claim 1, characterized in that each said coupling member is provided at said flange with a closure member.

4. A partition as claimed in claim 1, characterized in that a hinge, said coupling member, said flange and said closure member are made as a single unit by extrusion.

5. A partition as claimed in claim 1, characterized in that each panel edge is extended on said exterior side.

6. A partition as claimed in claim 1, in which each of two opposite panels of a module is provided with at least one spring blade pivotally connected therewith, one said bridge piece is provided with means for slidably guiding the spring blades.

7. A partition as claimed in claim 6, characterized in that said guide means are formed by two horizontally spaced pins, said bridge piece is provided with sockets spaced from each other and each pin passes through one said socket of said bridge piece.

8. A partition as claimed in claim 6, characterized in that each said bridge piece is provided with a central socket which receives a roller carrying pin with the rollers being adapted to roll along a top guide.

9. A partition as claimed in claim 6, characterized in that the cross-section of each said bridge piece has a bent-over shape.

10. A partition as claimed in claim 1, characterized in that at least one hinge between adjacent panels of a module is provided with a handle.

11. A partition as claimed in claim 10, characterized in that said hinge and said handle are formed by a single, extruded unit.

12. A partition as claimed in claim 1, wherein said connecting means includes a coupling strip of U-shaped cross-section having a first limb and a second limb, and said second limb has a projection extending therefrom so that an opening is formed which receives one of said flanges, thus fastening said coupling strip to the received said flange.

* * * * *